US006283246B1

(12) United States Patent
Nishikawa

(10) Patent No.: US 6,283,246 B1
(45) Date of Patent: Sep. 4, 2001

(54) SILENCER

(75) Inventor: Satofusa Nishikawa, Higashihiroshima (JP)

(73) Assignee: Betech Co., Ltd., Hiroshima (JP)

( * ) Notice: Subject to any disclaimer, the term of this patent is extended or adjusted under 35 U.S.C. 154(b) by 0 days.

(21) Appl. No.: 09/442,406

(22) Filed: Nov. 18, 1999

(51) Int. Cl.[7] ..... F01N 1/00
(52) U.S. Cl. ..... 181/255; 181/264; 181/272
(58) Field of Search ..... 181/255, 249, 181/264, 269, 272, 282

(56) References Cited

U.S. PATENT DOCUMENTS

| | | | | |
|---|---|---|---|---|
| 3,994,364 | * | 11/1976 | Nicoll | 181/255 |
| 5,246,473 | * | 9/1993 | Harris | 181/255 |
| 5,760,348 | * | 6/1998 | Heuser | 181/272 |

FOREIGN PATENT DOCUMENTS

| | | |
|---|---|---|
| 53-99448 | 1/1952 | (JP) . |
| 55-17906 | 7/1953 | (JP) . |
| 55-20648 | 7/1953 | (JP) . |
| 59-155521 | 4/1984 | (JP) . |
| 6-49708 | 7/1994 | (JP) . |
| 29-92513 | 10/1999 | (JP) . |

* cited by examiner

*Primary Examiner*—Khanh Dang
(74) *Attorney, Agent, or Firm*—Finnegan, Henderson, Farabow, Garrett & Dunner, L.L.P.

(57) ABSTRACT

A silencer for reducing and canceling medium- to low-frequency vibration and noise that generate in the reciprocating internal combustion engines and in the reciprocating air compressors. An inlet pipe having many ports perforated therein in the radial direction is inserted in a hollow triangular pole in the lengthwise direction thereof, the gas is blown into the hollow triangular pole, and the pulsating gases reflected by the walls in the hollow triangular pole are caused to collide with each other to cancel the pulsation.

7 Claims, 9 Drawing Sheets

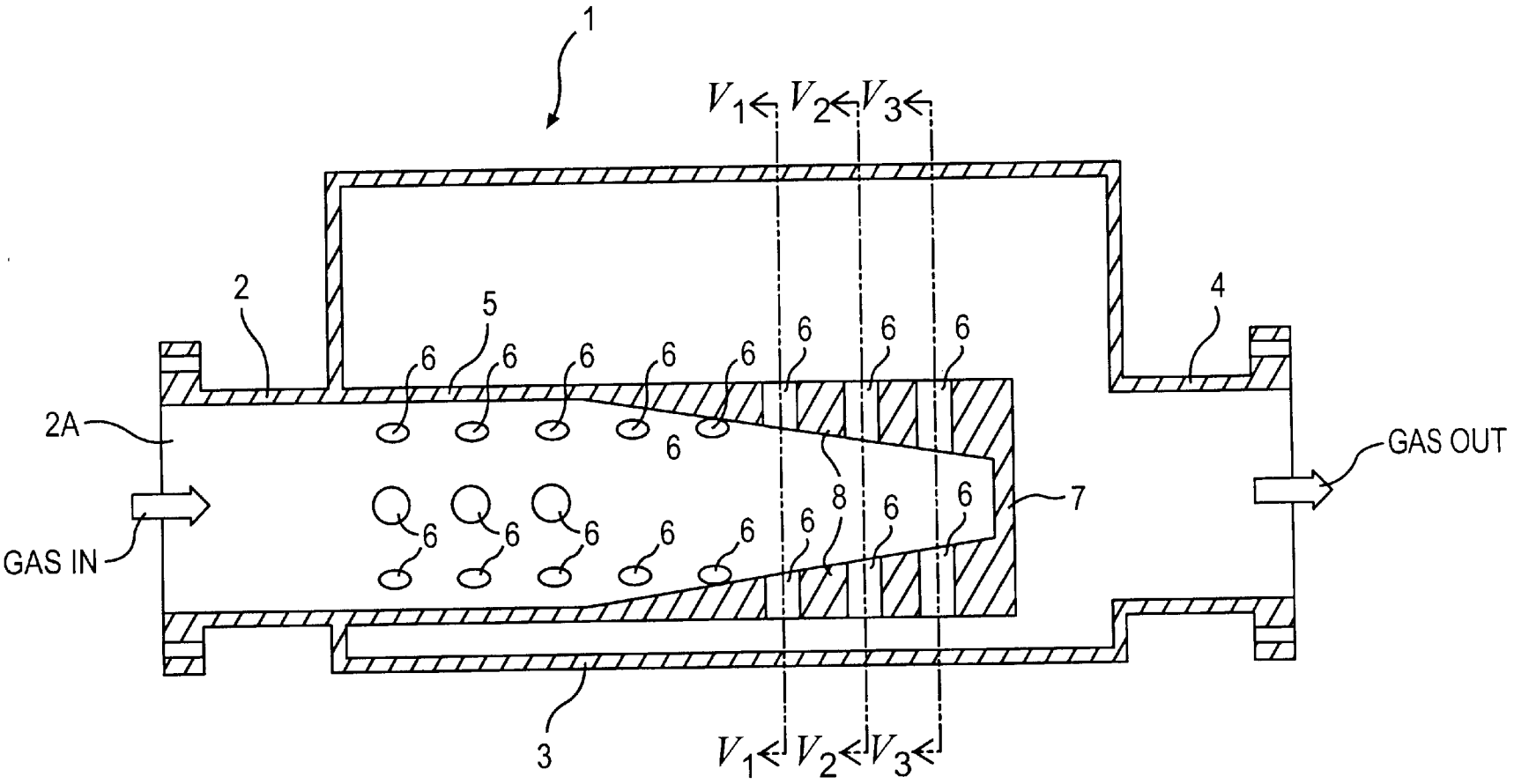
GAS OUT
4
7
6
6
6

SILENCER

BACKGROUND OF THE INVENTION

1. Field of the Invention

The present invention relates to a silencer. More particularly, the invention relates to a silencer effective in reducing and canceling pulsation and noise produced in the intake air and in the exhaust gas of gas compressors, such as in the intake air, exhaust gas, air and coolant of internal combustion reciprocating engines as represented by gasoline engines and diesel engines.

2. Description of the Prior Art

A variety of silencers (mufflers) have heretofore been proposed. In order to cope with noise and vibration, and to reduce and cancel pulsation in the intake air and in the exhaust gas, there have been proposed those which are in principle of the attenuation type, resonance type, sound-absorbing type, or a combination thereof.

In particular, in order to cope with noise and vibration of reciprocating engines and gas compressors, the silencers of the resonance type and attenuation type have chiefly been employed, and the study has been forwarded to a considerable degree concerning the structure and theory thereof.

For instance, Japanese Unexamined Patent Publication (Kokai) No. 155521/1984 teaches a silencer chiefly for the diesel engines having an additional by-pass exhaust pipe to deviate the phase of pulsation in the exhaust gas, so that the loop of a waveform A in a main exhaust pipe and a loop of a waveform B in the by-pass exhaust pipe are brought into agreement in a plus-to-minus relationship to reduce or cancel the amplitude of pulsation. However, this prior art involves a problem in that it is difficult to evenly distribute the exhaust gas stream into the main exhaust pipe and the by-pass exhaust pipe, which has not been solved yet.

In general, it is more difficult to reduce and cancel the pulsation in the intake air and in the exhaust gas in a region of low frequencies than in a region of high frequencies. At present, there has not still been provided the last silencer which is light in weight, compact in size and is effective in reducing undulation in the medium- to low-frequency regions.

SUMMARY OF THE INVENTION

The present inventors therefore have conducted keen study concerning the structures of the silencers of the resonance type and the attenuation type, i.e., the silencers for reducing and canceling pulsation by dispersing and canceling the pulsation. Through trial and error, the present inventors have arrived at the present invention that features a simple structure based on a hollow triangular pole and a great sound-silencing effect.

An object of the present invention is to provide a silencer for medium to low frequencies having a simple structure and featuring a large sound-silencing effect as compared to the rate of flowing the gas and the pulsating decibel.

Another object of the present invention is to provide a silencer of a compact and suitable size effective in reducing and canceling the pulsation irrespective of a fixed source of generating pulsation or moving source of generating pulsation.

The present invention provides:

a silencer in which a cylindrical inlet pipe is secured penetrating through one end surface of a hollow triangular pole and having a plurality of radial ports opened in the chamber of said hollow triangular pole in one or more sectional surfaces nearly at right angles with the axis of the pipe, an outlet pipe is secured penetrating through the other end surface of the hollow triangular pole, and pulsating gases emitted into said hollow triangular pole from the radial ports of said cylindrical inlet pipe come into collision with one another nearly in phase on a plane nearly at right angles with the axial direction of said cylindrical inlet pipe;

a silencer wherein said hollow triangular pole is a hollow equilateral triangular pole;

a silencer wherein said cylindrical inlet pipe has a bottom equipped, at the central portion on the bottom surface thereof, which a conical protuberance that is sharpened toward the inlet port;

a silencer wherein said cylindrical inlet pipe has a bottom and is tapered in a manner to decrease in cross section toward the outlet port; and a silencer wherein a cylindrical silencing chamber is further provided to surround said hollow triangular pole, and said hollow triangular pole has pairs of through holes opposed near the vertexes thereof.

BRIEF DESCRIPTION OF THE DRAWINGS

FIG. 4 is side sectional view illustrating an embodiment 2;

DESCRIPTION OF THE PREFERRED EMBODIMENTS

Figure 1:
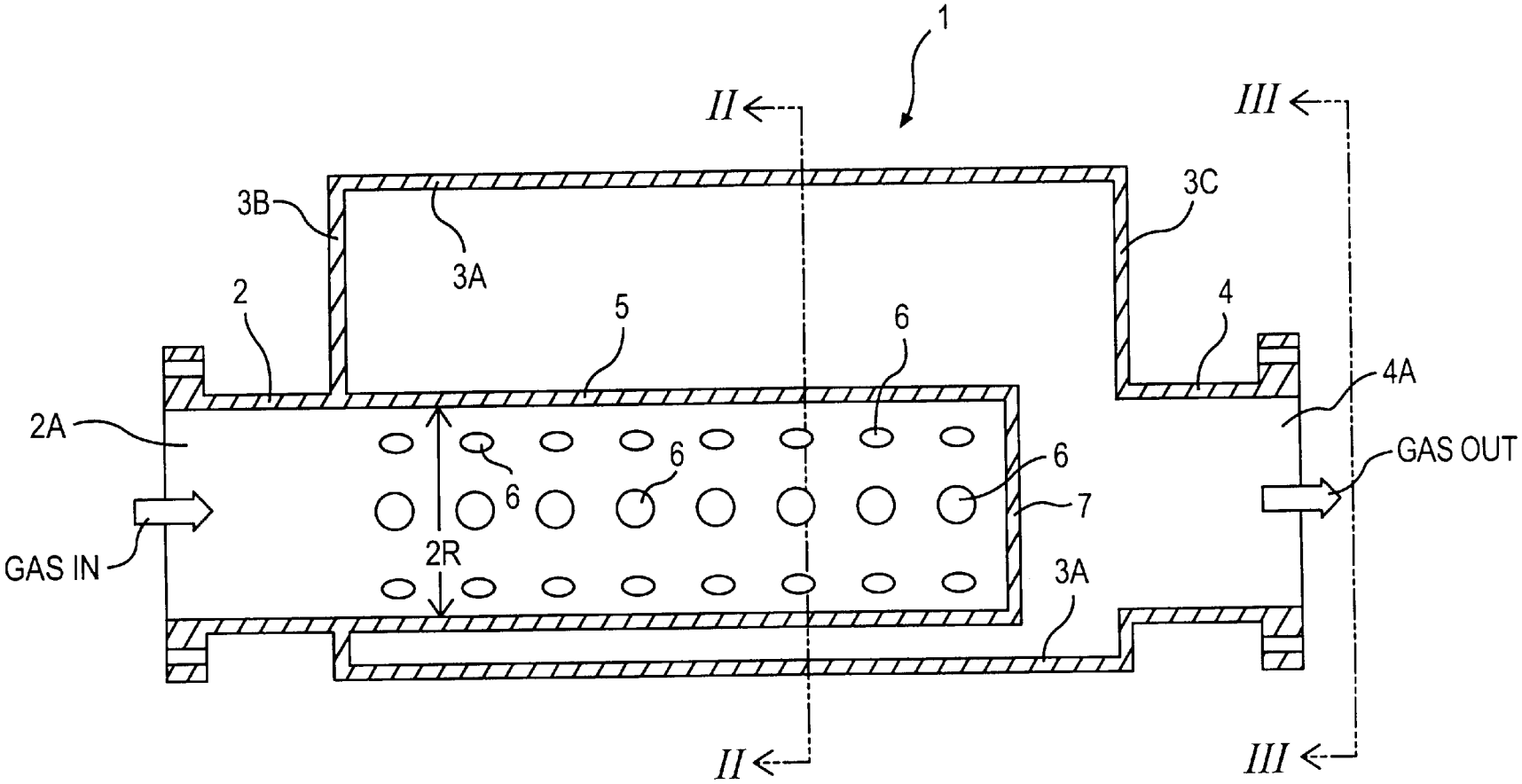
FIG. 1 is a side sectional view illustrating an embodiment 1 of the present invention.

In FIGS. 1 to 12, reference numeral 1 denotes a silencers, 2 denotes an inlet pipe, 2A denotes an inlet, 3 denotes a hollow triangular pole, 3A denotes inner walls of the hollow triangular pole, 3B denotes walls on the inlet side of the hollow triangular pole, 3C denotes walls on the outlet side of the hollow triangular pole, 4 denotes an outlet pipe, 4A denotes an outlet, 5 denotes a cylindrical inlet pipe, 6 denotes radial ports, 7 denotes a bottom of the inlet pipe, 8 denotes a frustoconical bottom, 9 denotes conical bottom, 11 denotes an intake valve, 11A denotes an intake valve stem, 12 denotes an exhaust valve, 12A denotes an exhaust valve stem, 13 denotes an outer cylinder, 13A denotes an inner wall of the outer cylinder, and reference numeral 20 denotes points where the collision of pulsation takes place.

Figure 3:
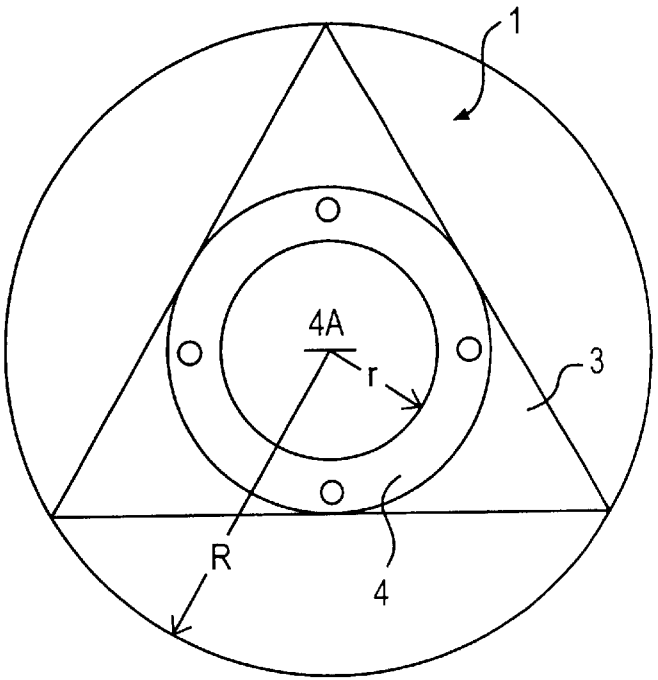
FIG. 3 is a view of the silencer of FIG. 1 is seen from the direction of arrow III—III.
Figure 2:
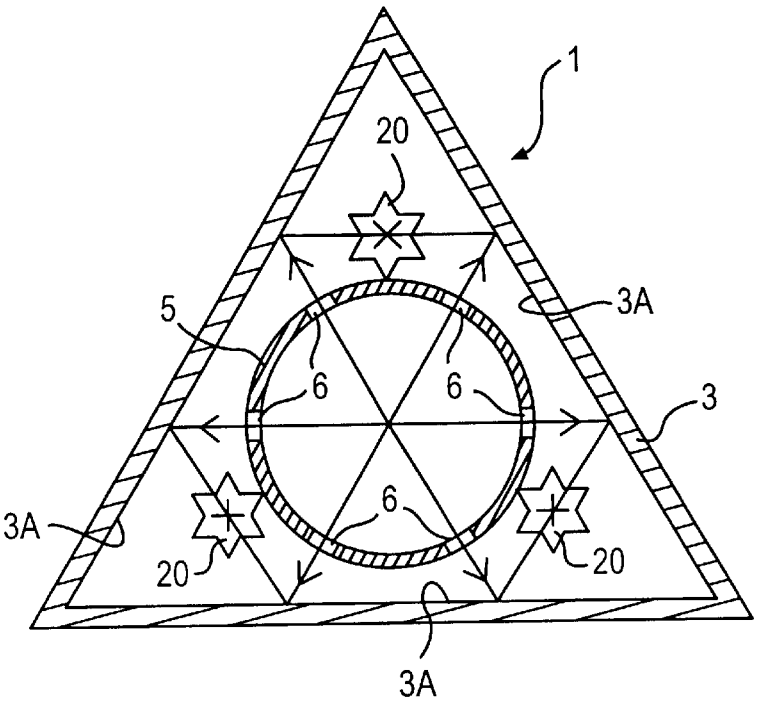
FIG. 2 is a sectional view along the arrow II—II in FIG. 1.

First, an embodiment 1 will be described. In FIGS. 1 to 3, the silencer 1 comprises the hollow triangular pole 3 and a cylindrical inlet pipe 5 that partly penetrates through the walls 3B of the inlet side. The inlet pipe 5 has many radial ports 6, 6,—radially opened in the hollow triangular pole 3 (see FIG. 2). As the internal pressure elevates, the gas is blown out toward the right through the outlet pipe 4 at the right end.

The silencing action is the same as that of the ordinary silencer. That is, the gas passes through the radial ports 6, 6,—of the inlet pipe and is blown out into the hollow triangular pole 3 which is an expansion chamber involving the flow-passage resistance, Moreover, as shown in FIG. 2, the gas blown out from the radial ports 6, 6,—of the inlet pipe 5 hits the inner walls 3A of the hollow triangular pole 3 and is regularly reflected nearly at an incident angle of 60 degrees and an outgoing angle of 60 degrees to come into collision nearly in phase at pulsation collision point 20, 20,—whereby loops of the pulsation collide with each other, so that sound is muffled and vibration and noise attenuate. It is therefore desired that the hollow triangular pole has an equilateral triangular shape in cross section. However, the similar sound-silencing effect is obtained even when the hollow triangular pole has a shape close to an isosceles triangle or a right-angled triangle in cross section, though the sound-silencing effect may be slightly deteriorated compared to the one having an equilateral triangular shape in cross section.

Figure 5:
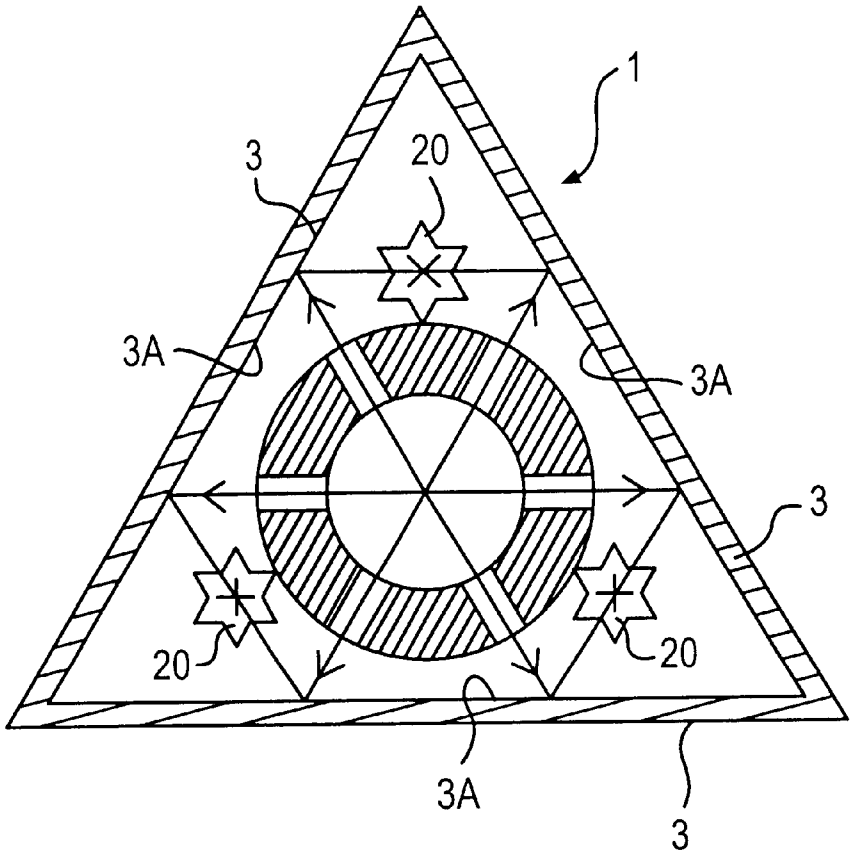
FIG. 5 is a sectional view along the arrow $V_2$—$V_2$ in FIG. 4.

FIG. 4 is a side sectional view of an embodiment and FIG. 5 is a sectional view along the arrow $V_2$—$V_2$ thereof, in which the bottom of the inlet pipe is tapered in a frusto-conical shape so that the diameter of the pipe gradually decreases toward the outlet side.

Figure 6:
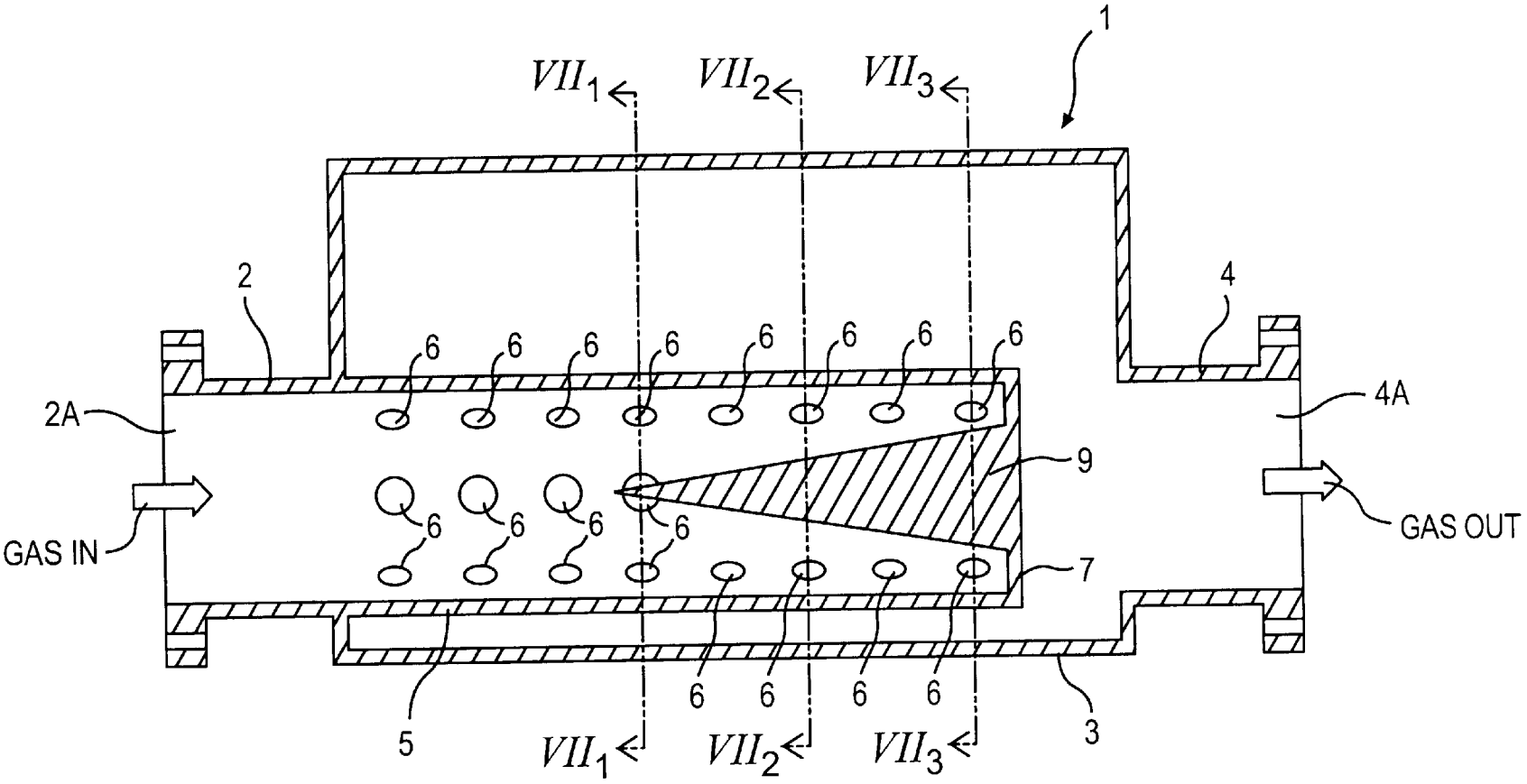
FIG. 6 is a side sectional view illustrating an embodiment 3.
Figure 7:
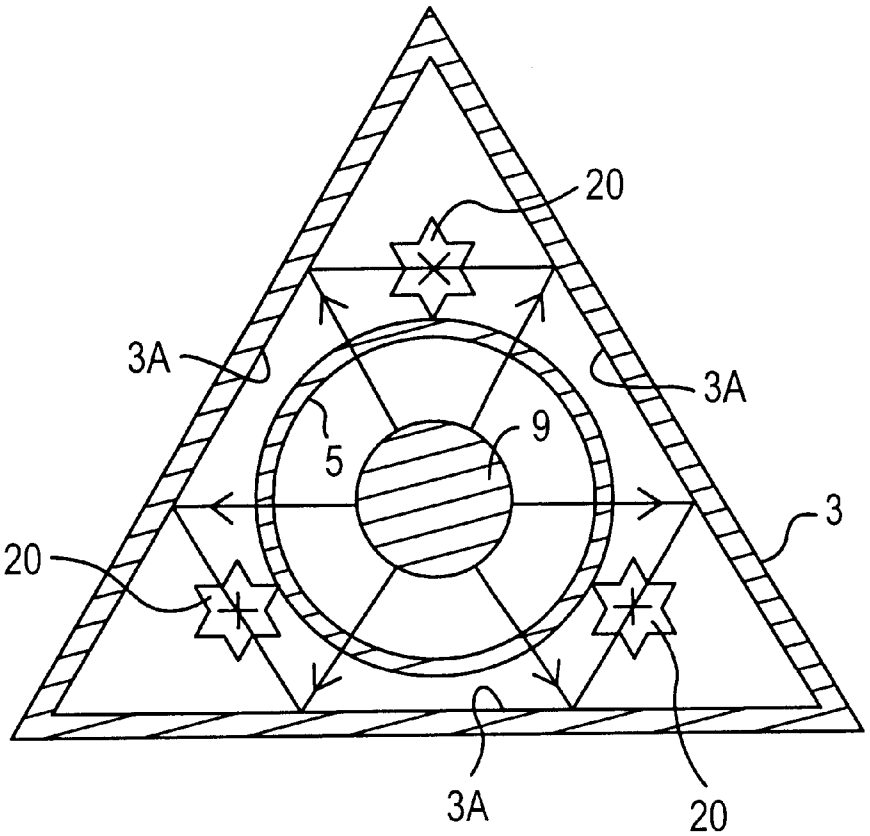
FIG. 7 is a sectional view along the arrow $VII_2$—$VII_2$ in FIG. 6.

Though the cross section along $V_1$—$V_1$ and the cross section along $C_3$—$C_3$ are not shown, the thickness of the inlet pipe 5 increases in order of $V_1$—$V_1$→$V_2$—$V_2$→$C_3$—$C_3$, and the length of the radial ports 6, 6,—gradually increases correspondingly. This gives a merit of reducing and canceling the occurrence of intense pulsation on the bottom as compared to when the bottom 7 is flat at the right end of the laterally arranged inlet pipe of the embodiment 1 (FIG. 1). That is, the pulsation is mildly received near the bottom of the inlet pipe, the gas is radially emitted in order of $V_1$—$V_1$, $V_2$—$V_2$, $V_3$—$V_3$, in the hollow triangular pole surrounding the inlet pipe 5, thereby to attenuate the pulsation successively (in series) in the step of gas flow passage. Conversely, as shown in FIGS. 6 and 7, the effect same as that of the embodiment 2 is obtained in order of $VII_1$—$VII_1$, $VII_2$—$VII_2$, $VII_3$—$VII_3$, even when a conical bottom 9 is employed by attaching a conical protuberance (cone) onto the bottom 7 of the inlet pipe so as to face the inlet. Here, the radial ports in the tilted portion may be $V_4$—$V_4$,—, $VII_4$—$VII_4$ on a plane, as a matter of course.

Referring to FIG. 3, it is considered that an optimum silencing condition exists not only under the conditions where there hold a relationship $r<R$ between the inner radius R of the inlet pipe and the radius R of a circle circumscribing three vertexes of an equilateral triangle in cross section of the inner walls of the surrounding hollow triangular pole but also under the conditions where the inner radius R of the outlet pipe 4A is smaller by the thickness $+\alpha$ than a circle inscribing the triangle in cross section of the inner walls.

Figure 9:
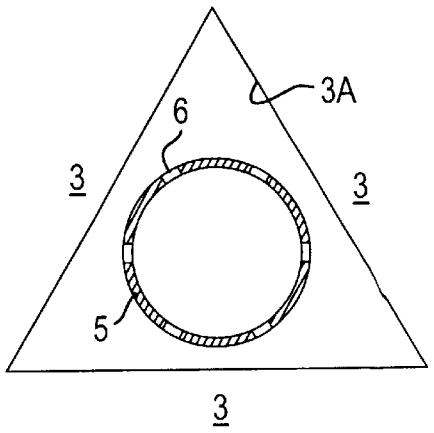
FIG. 9 is a sectional view along the arrow IX—IX in FIG. 8.
Figure 8:
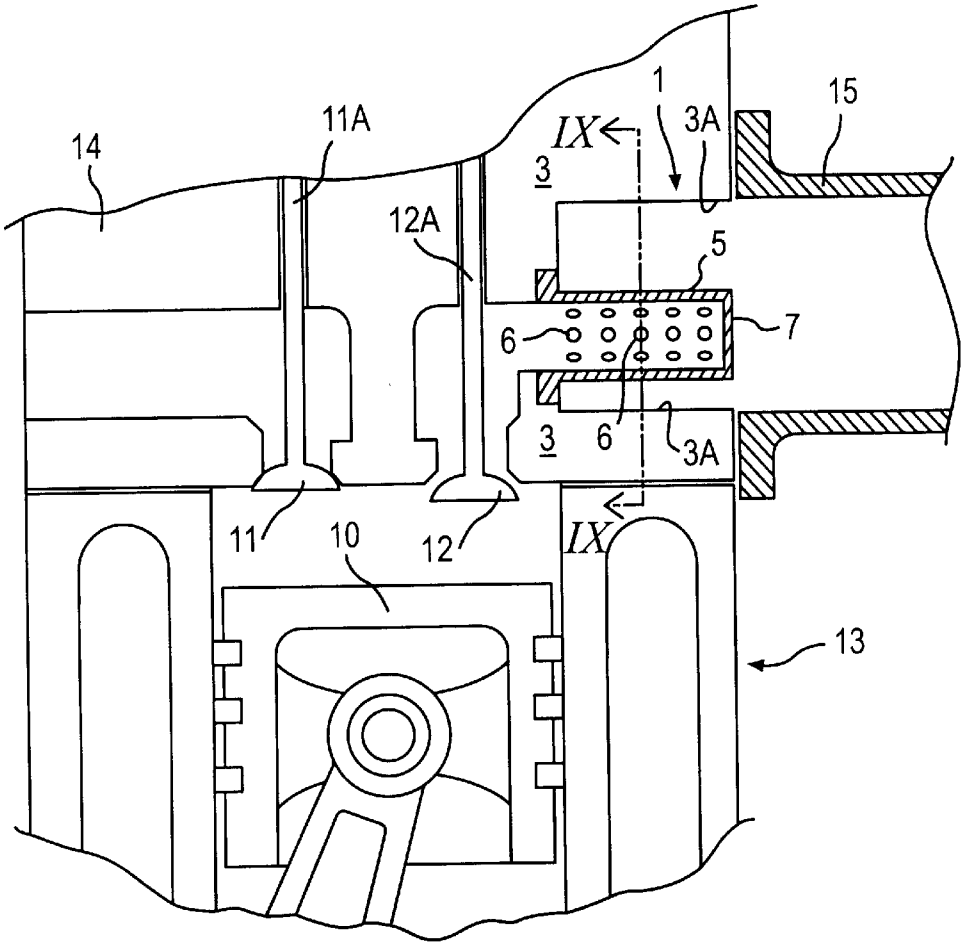
FIG. 8 is a side sectional view illustrating an embodiment 4.
Figure 10:
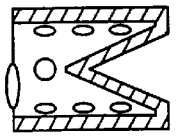
FIG. 10 is a side view illustrating a major portion of an embodiment 5.

FIG. 8 is a side view of an embodiment 4 of when the present invention is applied to an exhaust port o an OHV-type gasoline engine or diesel engine, and FIG. 9 is a sectional view thereof along the arrow E—E. It has been known that an unexpectedly high silencing effect is obtained even when the exhaust gas has a high temperature and a high pressure. However, since the exhaust resistance tends to increase, the silencer cannot be used for the engines that run at high speeds. FIG. 10 is a sectional view illustrating a major portion of when the shape of the inlet pipe of the embodiment 4 is modified into a shape shown in FIG. 6. This modification is included in the scope of the invention as a matter of course.

Figure 11:
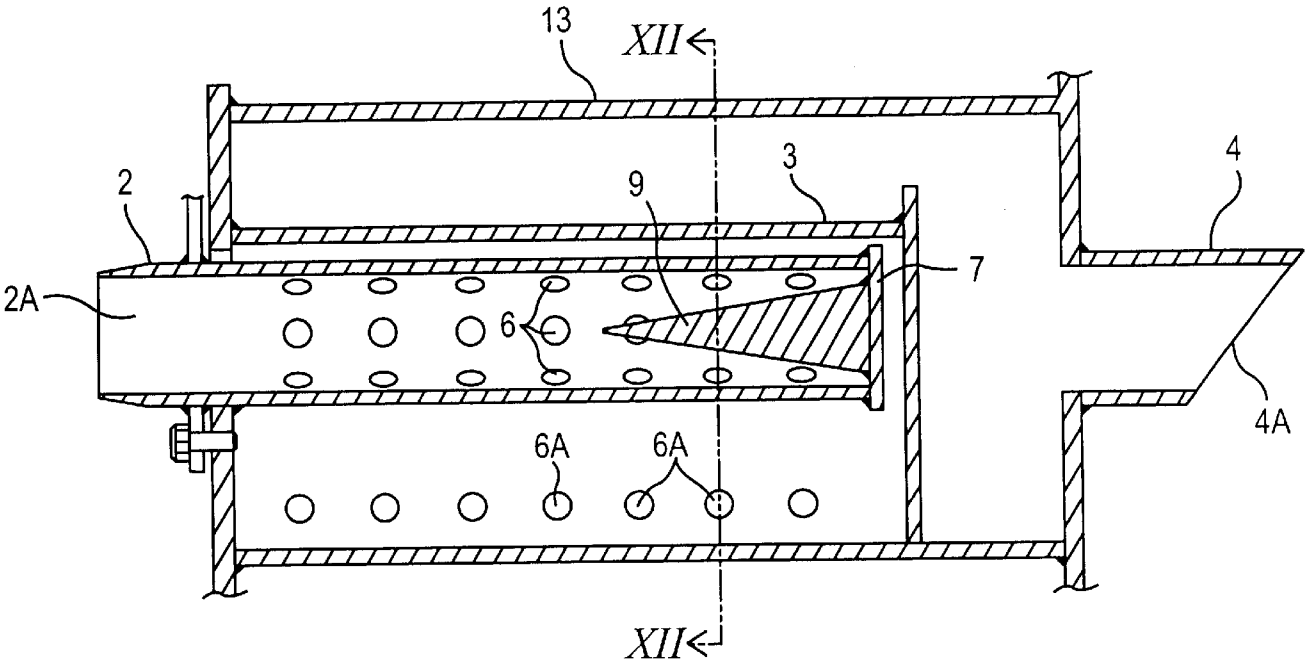
FIG. 11 is a side sectional view illustrating an embodiment 6.
Figure 12:
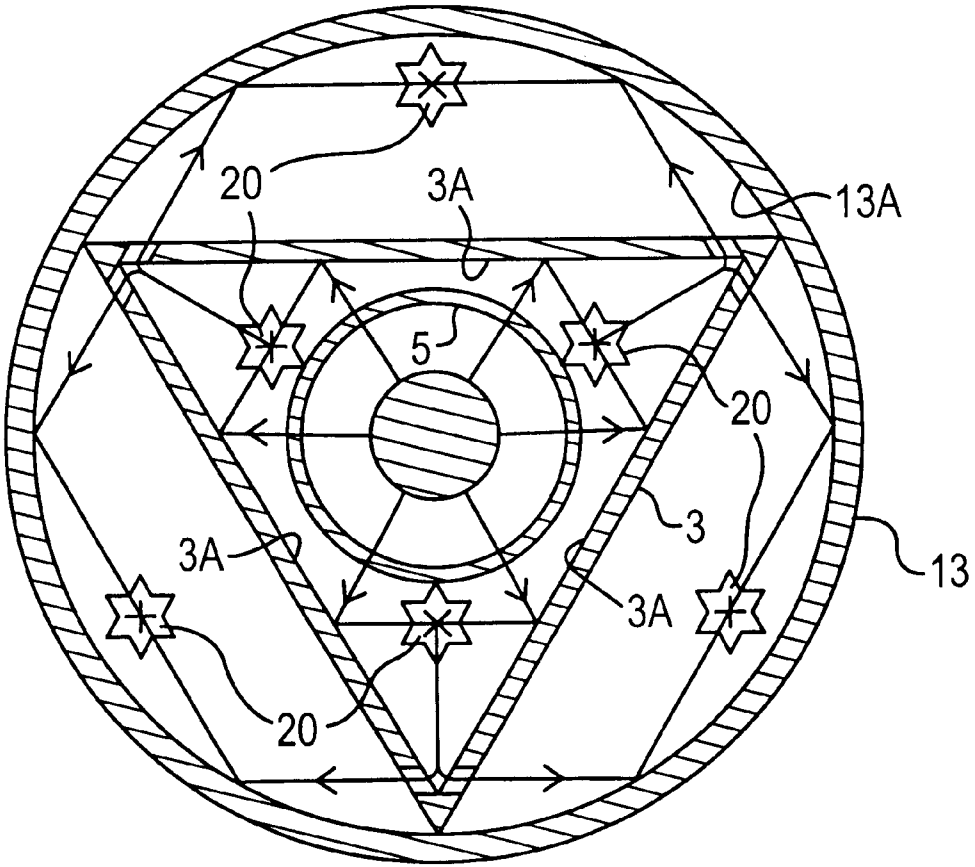
FIG. 12 is a sectional view along the arrow XII—XII in FIG. 11.

FIG. 11 is a side sectional view of an embodiment 6 in which the pulsation collision points are formed in a multiplicity of states in the radial direction instead of in the lengthwise direction unlike the embodiments 2 and 3 of FIGS. 4 and 6. FIG. 12 is a sectional view along the arrow VII—VII in FIG. 11. In principle, this embodiment is the same as those of FIGS. 4 and 6. When limitation is imposed on the length of the structure, however, the pulsation collision points can be constituted in many stages in the radial direction, which is a merit. The above-mentioned embodiments 1 to 6 can be applied not only to the engines that emit exhaust gas of high pressures to the inlet side thereof but also to the intake system of the compressors in which the pressure decreases on the inlet side, to effectively muffle the noise.

(1) The embodiment was applied to a reciprocating air compressor of a large type to greatly decrease vibration in the compressor body and in the air-blowing conduits.

(2) When used for a reciprocating internal combustion engine, ① the volume of the silencer could be decreased to be not larger than 70% that of the conventional counterpart to obtain an equivalent silencing effect. When compared on the basis of the same volume, the silencing effect could be enhanced by more than 4 db. ② In the conventional silencer, the exhaust gas flows in the axial direction. In the silencer of the present invention, however, the exhaust gas flows in the radial direction nearly symmetrically maintaining good balance. Therefore, the silencer itself does not vibrate. When used for a large engine, vibration is decreased to almost zero.

The embodiments of the present invention make it possible to accomplish all of the above-mentioned objects. That is, the embodiments markedly reduce and cancel vibration and noise in the medium to low frequency regions, that are generally difficult to muffle.

What is claimed is:

1. A silencer, comprising:

a hollow triangular pole having end surfaces and a chamber;

a cylindrical inlet pipe secured to and penetrating through one of the end surfaces of said hollow triangular pole and having a plurality of radial ports opened to the chamber of said hollow triangular pole in one or more sectional surfaces nearly at right angles with an axis of the pipe; and an outlet pipe secured to and penetrating through the other of the end surfaces of the hollow triangle pole, wherein pulsating gases emitted into said hollow triangular pole from the radial ports of said cylindrical inlet pipe come into collision with one another nearly in same phase on a plane nearly at right angles with the axial direction of said cylindrical inlet pipe.

2. A silencer according to claim 1, wherein said hollow triangular pole is a hollow equilateral triangular pole.

3. The silencer according to claim 1, wherein said cylindrical inlet pipe has a bottom surface equipped, at a central portion on the bottom surface, with a conical protuberance that is sharpened toward an inlet port of the inlet pipe.

4. The silencer according to claim 1 or claim 2, wherein said cylindrical inlet pipe has a bottom and is tapered so that a cross-sectional area of the inlet pipe decreases toward the bottom.

5. The silencer of according to claim 1, further comprising a cylindrical silencing chamber surrounding said hollow triangular pole, and said hollow triangular pole having pairs of through holes near vertexes thereof.

6. The silencer according to claim 3, wherein said cylindrical inlet pipe is tapered so that a cross-sectional area of the inlet pipe decreases toward the bottom.

7. A silencer, comprising:

a hollow triangular pole having first and second end walls and side walls defining a chamber;

a cylindrical inlet pipe penetrating through the first end wall of the hollow triangular pole, the inlet pipe having a plurality of radial ports opened to the chamber of the hollow triangular pole in a direction orthogonal to an axial direction of the inlet pipe such that gases emitted into the hollow triangular pole from the radial ports collide with one another substantially in a substantially same phase on a plane substantially orthogonal to the axial direction of the inlet pipe; and an outlet pipe secured to the second end wall and having an opening connected to the chamber to exit the gases.

* * * * *

UNITED STATES PATENT AND TRADEMARK OFFICE

CERTIFICATE OF CORRECTION

PATENT NO. : 6,283,246 B1
DATED : September 4, 2001
INVENTOR(S) : Satofusa Nishikawa It is certified that error appears in the above-identified patent and that said Letters Patent is hereby corrected as shown below:

Column 4, claim 1,
Line 62, "triangle pole" should read -- triangular pole --.

Column 5, claim 5,
Line 11, after "The silencer", delete "of".

Signed and Sealed this

Eighteenth Day of December, 2001

*Attest:*

*Attesting Officer*

JAMES E. ROGAN
*Director of the United States Patent and Trademark Office*